US008248349B2

(12) United States Patent
Park et al.

(10) Patent No.: US 8,248,349 B2
(45) Date of Patent: Aug. 21, 2012

(54) LIQUID CRYSTAL DISPLAY HAVING ENDURANCE AGAINST ELECTROSTATIC DISCHARGE

(75) Inventors: Jae-Hyoung Park, Asan-si (KR); Ik-Hyun Ahn, Cheonan-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 903 days.

(21) Appl. No.: 12/348,186

(22) Filed: Jan. 2, 2009

(65) Prior Publication Data

US 2010/0033453 A1 Feb. 11, 2010

(30) Foreign Application Priority Data

Aug. 5, 2008 (KR) ..... 10-2008-0076673

(51) Int. Cl.
*G09G 3/36* (2006.01)

(52) U.S. Cl. ..... 345/98; 345/204

(58) Field of Classification Search ..... 345/87–100, 345/204
See application file for complete search history.

(56) References Cited

U.S. PATENT DOCUMENTS 7,812,833 B2 * 10/2010 Kim et al. ..... 345/204
8,040,939 B2 * 10/2011 Kim et al. ..... 345/98
2007/0164969 A1 * 7/2007 Kim ..... 345/99

* cited by examiner

*Primary Examiner* — Regina Liang
(74) *Attorney, Agent, or Firm* — F. Chau & Associates, LLC

(57) ABSTRACT

In a liquid crystal display equipped with a timing controller, the timing controller generates a restoration signal having a predetermined pulse width in response to a data enable signal and operates in a fail mode when a difference between the data enable signal and the restoration signal is larger than a threshold value. Even if the data enable signal is distorted by electrostatic discharge, the liquid crystal display uses the restoration signal as a data enable signal without entering the fail mode when the distortion degree is smaller than the threshold value. Thus, a user may not recognize the electrostatic discharge when the electrostatic discharge is applied to the liquid crystal display for a short period of time.

20 Claims, 7 Drawing Sheets

LIQUID CRYSTAL DISPLAY HAVING ENDURANCE AGAINST ELECTROSTATIC DISCHARGE

CROSS-REFERENCE TO RELATED APPLICATION

This application claims priority to Korean Patent Application No. 2008-76673, filed on Aug. 5, 2008, the disclosure of which is incorporated by reference in its entirety herein.

BACKGROUND

1. Technical Field

The present disclosure relates to a liquid crystal display and a timing controller for a liquid crystal display. More particularly, the present disclosure relates to a liquid crystal display having improved endurance against electrostatic discharge.

2. Discussion of Related Art

A liquid crystal display may include two display substrates and a liquid crystal layer that is interposed between the two display substrates. Liquid crystal molecules of the liquid crystal layer may exhibit dielectric anisotropy. The liquid crystal display may obtain a desired image by applying an electric field to the liquid crystal layer and then adjusting an intensity of the electric field to control transmittance of light passing through the liquid crystal display. The liquid crystal display may disposed within a flat panel display (FPD) as a monitor of a computer or a television set.

The liquid crystal display may include a plurality of integrated circuits (ICs) to display the images. However, the ICs may malfunction or become damaged due to static electricity (e.g., electrostatic discharge (ESD). A malfunction caused by ESD may be classified into hard and soft fails, and temporal noise. A hard fail occurs when the IC is permanently damaged by the ESD. A soft fail occurs when the IC temporarily malfunctions, but returns to its normal state by a reset operation. A temporal noise occurs when the IC malfunctions momentarily during the ESD, but then quickly returns to a normal state.

When a hard fail occurs, a user must replace the damaged IC with a new one. When a soft fail occurs, the liquid crystal display enters a fail mode such that the image displayed on a panel is turned off or a specific image is displayed on a screen and then returns to the normal state. Accordingly, the user recognizes the abnormal state of the screen even though the liquid crystal display returns to the normal state after the soft fail.

Thus, there is a need for a liquid crystal display with greater resilience to electrostatic discharge.

SUMMARY

An exemplary embodiment of the present invention includes a timing controller The timing controller may be used to control the driving of a liquid crystal display. The timing controller includes a restoration circuit and a fail detector. The restoration circuit receives an input signal and outputs a restoration signal based on the input signal. The restoration signal may be output with a predetermined pulse width. The restoration circuit includes a delay circuit and a restoration signal generator. The delay circuit receives the input signal and delays the input signal to output a delayed input signal. The restoration signal generator receives the delayed input signal and generates the restoration signal based on the delayed input signal. The restoration signal generator activates the restoration signal when the delayed input signal is activated and then deactivates the restoration signal after a period of time has elapsed. The fail detector receives the input signal and the restoration signal. The fail detector activates a fail signal when a difference between the input signal and the restoration signal is larger than a threshold value. The period of time may correspond to a predetermined number of cycles of a clock signal.

The delay circuit may include a plurality of flip-flops that are connected to each other in series and sequentially latch the input signal in synchronization with the clock signal. The delay circuit may further include a logic circuit that receives an output of each flip-flop to output the delayed input signal.

The restoration signal generator may include a counter that starts counting in response to the delayed input signal and performs a count up in synchronization with the clock signal. The restoration signal generator may deactivate the restoration signal after the period of time has elapsed when a count value of the counter reaches a predetermined value.

The input signal may include a data enable signal. The restoration circuit may further include a data delay circuit that receives an image data signal and delays the image data signal based on a delay time of the delay circuit to output a delayed image data signal.

The fail detector may include an input delay circuit, a pulse width detector, a threshold value selector, and a fail discriminator. The input delay circuit may delay the data enable signal. The pulse width detector may output a differential value corresponding to a difference between a signal output from the input delay circuit and the restoration signal. The threshold value selector may output the threshold value. The fail discriminator may compare the threshold value with the differential value and activate the fail signal when the differential value is larger than the threshold value.

The fail discriminator may include a comparator and a fail signal generator. The comparator may compare the threshold value with the differential value and activate a comparison signal when the differential value is larger than the threshold value. The fail signal generator may activate the fail signal in response to the comparison signal and deactivate the fail signal in response to the restoration signal. The fail signal generator may deactivate the fail signal at a falling edge of the data enable signal.

The threshold value selector may receive a first parameter corresponding to a fail determination time and a second parameter corresponding to a delay time of the input delay circuit to output one of the first and second parameters as the threshold value.

The pulse width detector may include a logic circuit and counter. The logic circuit may output a differential signal corresponding to a difference between the signal output from the input delay circuit and the restoration signal. The counter may output a count value corresponding to a pulse width of the differential signal in synchronization with the clock signal. The fail signal may be maintained in a deactivated state when the difference between the data enable signal and the restoration signal is smaller than the threshold value.

The timing controller may further include a functioning block that operates in response to the restoration signal and the delayed image data signal. The functioning block may operate in a fail mode when the fail signal is activated.

An exemplary embodiment of the present invention includes a liquid crystal display. The liquid crystal display includes a liquid crystal panel provided with a plurality of data lines and a plurality of gate lines, a driving circuit driving the data lines and the gate lines, and a timing controller that receives an image data signal, a data enable signal and a clock signal to output control signals to control the driving circuit. The timing controller generates a restoration signal having a predetermined pulse width in response to the data enable signal and operates in a fail mode when a difference between the data enable signal and the restoration signal is larger than a threshold value.

The timing controller may include a restoration circuit and a restoration signal generator. The restoration circuit delays the data enable signal by a predetermined time to output a delay signal. The restoration signal generator generates the restoration signal activated in response to the delay signal and maintains the restoration signal in an activated state for a predetermined cycle of the clock signal. The image data signal may be delayed by a delay time of the delay circuit and may then be provided to the driving circuit. The timing controller may return from the fail mode to a normal mode when the restoration signal is deactivated.

A liquid crystal display according to at least one exemplary embodiment of the present invention does not enter a fail mode when a data enable signal DE is distorted by electrostatic discharge if the data enable signal DE can be restored. Accordingly, a user may not recognize the electrostatic discharge when the electrostatic discharge is applied to the liquid crystal display for a short period of time.

Another exemplary embodiment of the present invention includes a liquid crystal display. The liquid crystal display includes a liquid crystal panel provided with a plurality of data lines and a plurality of gate lines, a driving circuit driving the data lines and the gate lines, and a timing controller that receives an image data signal, a data enable signal and a clock signal to output control signals to control the driving circuit. The timing controller includes a restoration circuit, a fail detector, and a functioning block.

The restoration circuit receives the data enable signal and generates a restoration signal based on the data enable signal. The restoration circuit includes a first delay circuit, a second delay circuit, and a restoration signal generator. The first delay circuit receives the data enable signal and delays the data enable signal to output a delayed data enable signal. The second delay circuit receives the image data signal and delays the image data signal to output a delayed image data signal. The restoration signal generator receives the delayed data enable signal and the clock signal, activates the restoration signal when the delayed data enable signal is activated, and then deactivates the restoration signal after a predetermined number of cycles of the clock signal have elapsed.

The fail detector receives the data enable signal and the restoration signal. The fail detector activates a fail signal when a difference between the data enable signal and the restoration signal is larger than a threshold value. The functioning block receives the fail signal and the delayed image data signal. The functioning block provides the delayed image data signal to the driving circuit when the fail signal is deactivated and provides a predetermined image data signal indicative of a failure to the driving circuit when the fail signal is activated

BRIEF DESCRIPTION OF THE DRAWINGS

Exemplary embodiments of the present invention will become readily apparent by reference to the following detailed description when considered in conjunction with the accompanying drawings wherein.

DETAILED DESCRIPTION OF EXEMPLARY EMBODIMENTS

Hereinafter, exemplary embodiments of the present invention will be explained in detail with reference to the accompanying drawings.

Figure 1:
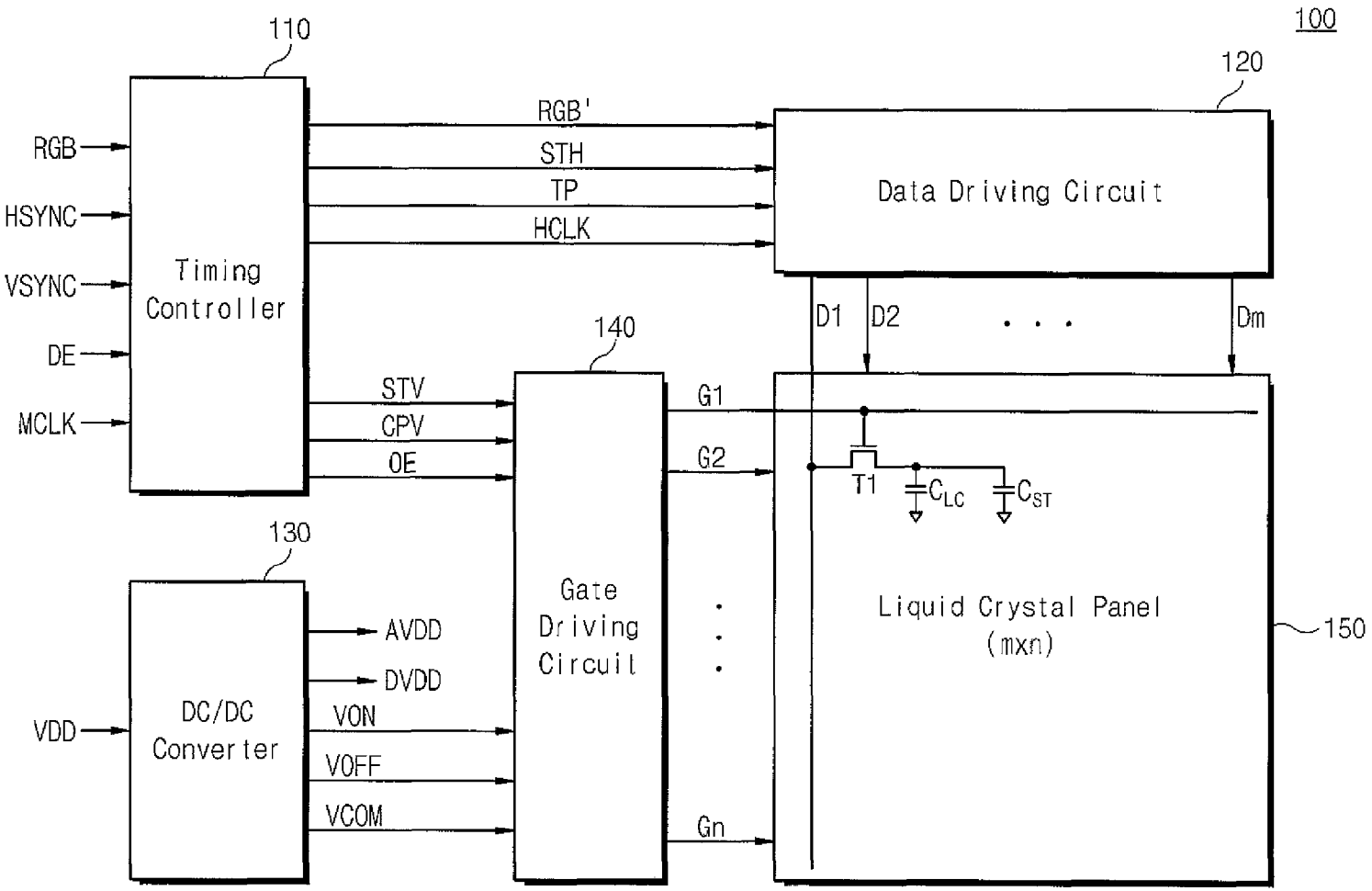
FIG. 1 is a block diagram showing a liquid crystal display according to an exemplary embodiment of the present invention.

FIG. 1 is a block diagram showing a liquid crystal display according to an exemplary embodiment of the prevent invention. Referring to FIG. 1, a liquid crystal display 100 includes a timing controller 110, a data driving circuit 120, a voltage converter 130, a gate driving circuit 140 and a liquid crystal panel 150.

The liquid crystal panel 150 includes a plurality of gate lines G1 to Gn, a plurality of data lines D1 to Dm which cross the gate lines, and pixels disposed in pixel areas defined by the gate lines G1 to Gn and the data lines D1 to Dm. Each pixel includes a thin film transistor T1 having a gate electrode and a source electrode that are connected to the gate lines G1 to Gn and the data lines D1 to Dm, respectively, a liquid crystal capacitor $C_{LC}$ and a storage capacitor $C_{ST}$ that are connected to a drain electrode of the thin film transistor T1. When the gate lines G1 to Gn are sequentially selected by the gate driving circuit 140 and a gate-on voltage is applied to the selected gate line in the form of a pulse, the thin film transistor T1 connected to the selected gate line is turned on. A voltage containing pixel information is applied to the data lines D1 to Dm by the data driving circuit 120. As the voltage passes through the thin film transistor T1 of the corresponding pixel and is applied to the liquid crystal capacitor $C_{LC}$ and the storage capacitor $C_{ST}$, the liquid crystal capacitor $C_{LC}$ and the storage capacitor $C_{ST}$ are driven, thereby displaying an image.

The timing controller 110 receives a present pixel data signal RGB, a horizontal synchronization signal HSYNC, a vertical synchronization signal VSYNC, a clock signal MCLK and a data enable signal DE that may be supplied from an external device (not shown). The timing controller 110 outputs a pixel data signal RGB' and control signals to the data driving circuit 120. The pixel data signal RGB' has a data format that conforms to a specification of an interface between the timing controller and the data driving circuit 120. The control signals may include a latch signal TP, a horizontal synchronization start signal STH, a clock signal HCLK, a first inversion driving signal and a second inversion driving signal. The first and second inversion driving signals are complementary signals having phases opposite to each other.

The voltage converter 130 may receive an external voltage VDD from an external source (not shown) to generate voltages to operate the liquid crystal display 100. For example, the voltages may include a gate-on voltage VON, a gate-off voltage VOFF, an analog power voltage AVDD, a digital power voltage DVDD and a common voltage VCOM. The gate-on voltage VON and the gate-off voltage VOFF are provided to the gate driving circuit 140, and the analog power voltage AVDD and the digital power voltage DVDD are used as an operating voltage of the liquid crystal display 100.

The gate driving circuit 140 sequentially scans the gate lines G1 to Gn of the liquid crystal display panel 150 in response to the control signals (e.g., a vertical synchronization start signal STV, a gate clock signal CPV and an output enable signal OE) provided from the timing controller 110. The scanning represents an operation to set the pixel, which is adjacent to the gate line receiving the gate-on voltage VON, so as to record data by sequentially applying the gate-on voltage VON to the gate lines G1 to Gn.

The data driving circuit 120 drives the data lines D1 to Dm of the liquid crystal panel 150 by using a gray scale voltage. The gray scale voltage may be generated from a gray scale voltage generator (not shown) in correspondence with the pixel data signal RGB', in response to the control signals (e.g., the latch signal TP, the horizontal synchronization start signal STH, the clock signal HCLK and the first and second inversion driving signals) provided from the timing controller 110.

The data driving circuit 120 may include a plurality of integrated circuits. If static electricity is introduced into a signal input terminal of the liquid crystal display 100 having the above-described structure, the integrated circuits of the liquid crystal display 100 may malfunction or be damaged. The electrostatic discharge may occur frequently when the timing controller 110 includes pads (not shown) for receiving signals from an external source. When the static electricity is introduced into an input pad of the data enable signal DE or a clock signal MCLK, the liquid crystal display 100 may enter a fail mode.

Figure 2:
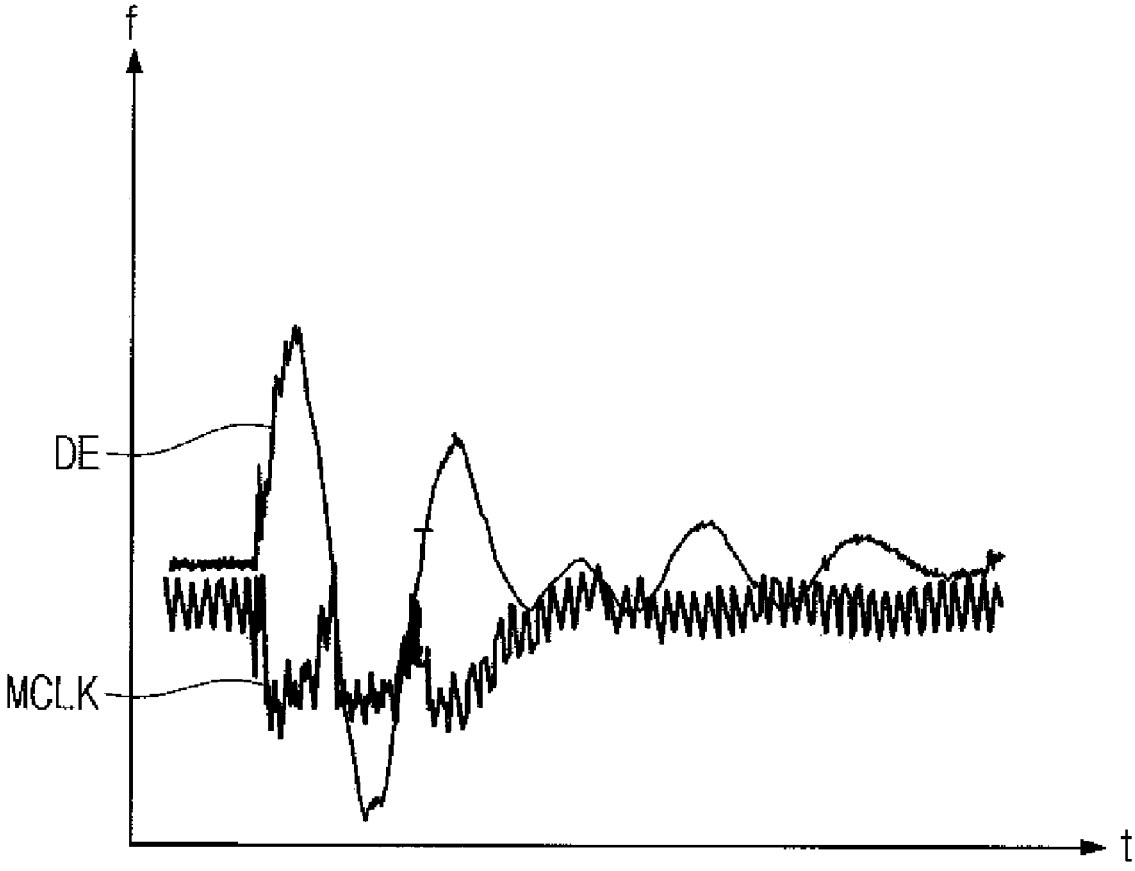
FIG. 2 is a graph showing a data enable signal and a clock signal that are distorted by electrostatic discharge.

FIG. 2 is a graph showing the data enable signal and the clock signal being distorted by electrostatic discharge. The electrostatic discharge may change a pulse width of the data enable signal DE, thereby resulting in a malfunction of the liquid crystal display 100.

Figure 3:
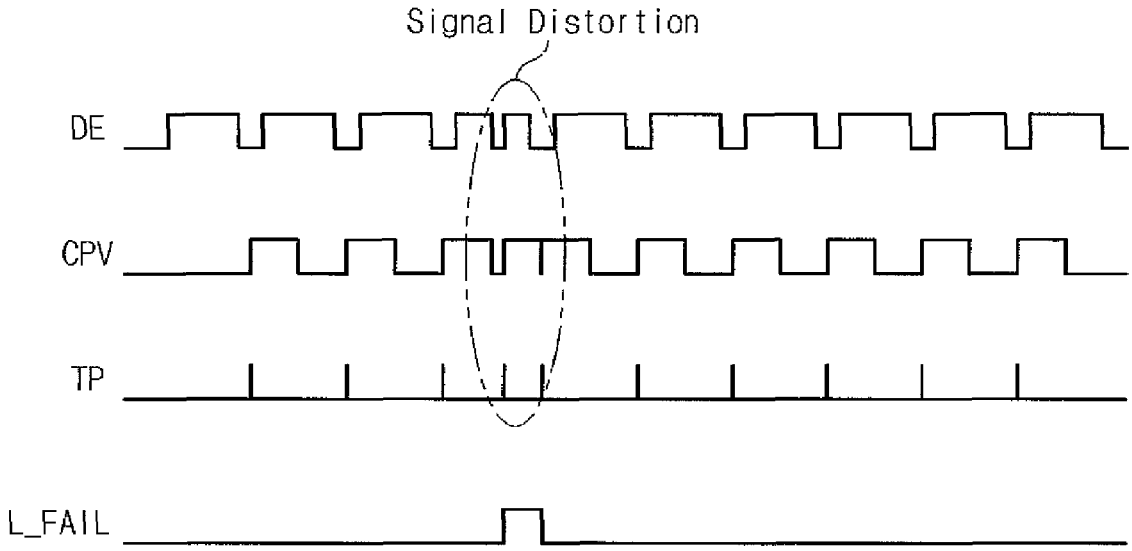
FIG. 3 is a timing diagram showing an output signal output from a timing controller when a distortion occurs in the data enable signal.

FIG. 3 is a timing diagram showing signals output from the timing controller when a distortion occurs in the data enable signal. Referring to FIG. 3, when the distortion causing the change in the pulse width of the data enable signal DE occurs, the gate clock signal CPV and the latch signal TP output from the timing controller 110 are distorted. When the timing controller 110 detects that the pulse width of the data enable signal DE is suddenly changed by the electrostatic discharge, the timing controller 110 operates in the fail mode by activating a line fail signal L_FAIL. During the fail mode, the timing controller 110 restores the data enable signal DE into the normal state, and allows a predetermined image to be displayed on the liquid crystal panel 150. When the data enable signal DE is restored to a normal state, the timing controller 110 returns from the fail mode to a normal mode. However, the user recognizes that an error has occurred in the liquid crystal display 100 based on the image displayed on the liquid crystal panel 150.

Accordingly, if the data enable signal DE can be restored to the normal state, despite the distortion of the data enabling signal DE, a timing controller 110 according to an exemplary embodiment of the present invention does not enter the fail mode, thereby preventing the user from recognizing the malfunction of the liquid crystal display 100.

Figure 4:
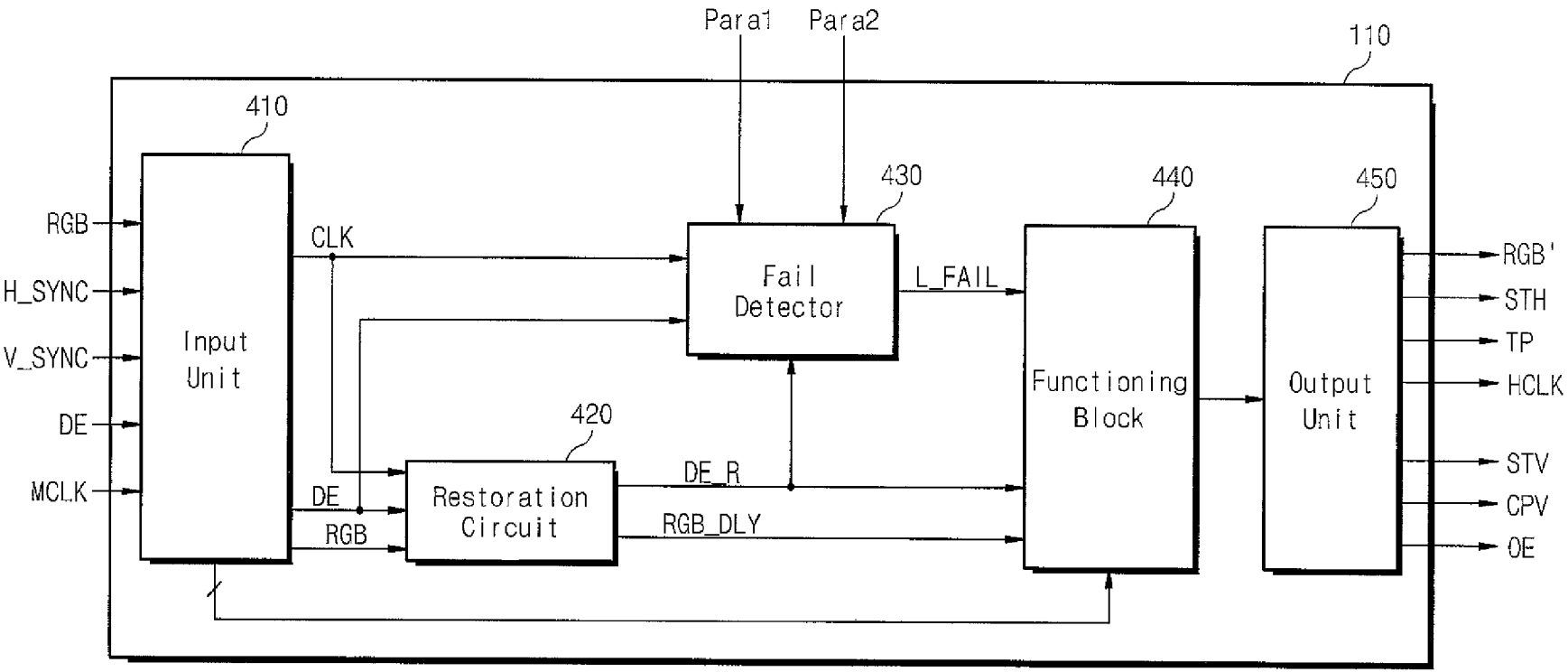
FIG. 4 is a block diagram showing a timing controller according to an exemplary embodiment of the present invention.

FIG. 4 is a block diagram showing the timing controller according to an exemplary embodiment of the present invention. Referring to FIG. 4, the timing controller 110 includes an input unit 410, a restoration circuit 420, a fail detector 430, a functioning block 440 and an output unit 450.

The input unit 410 receives the pixel data signal RGB, the horizontal synchronization signal H_SYNC, the vertical synchronization signal V_SYNC, the clock signal CLK and the data enable signal DE from a host (not shown). The restoration circuit 420 receives the clock signal CLK, the data enable signal DE and the pixel data signal RGB through the input unit 410 and then outputs a restoration signal DE_R for the data enable signal DE and a delayed pixel data signal RGB_DLY.

The fail detector 430 receives the clock signal CLK and the data enable signal DE through the input unit 410, receives the restoration signal DE_R from the restoration circuit 420, and first and second parameters Para1 and Para2, thereby outputting the line fail signal L_FAIL. The functioning block 440 operates in response to the control signals provided from the input unit 410, the restoration signal DE_R and the delayed pixel data signal RGB_DLY, which are provided from the restoration circuit 420, and the line fail signal L_FAIL provided from the fail detector 430. The clock signal CLK provided to the restoration circuit 420 and the fail detector 430 from the input unit 410 may have a frequency identical to or different from that of the clock signal MCLK provided from the host.

The output unit 450 converts signals output from the functioning block 440 into signals having a format suitable for output to the data driving circuit 120 and the gate driving circuit 140 shown in FIG. 1.

Figure 5:
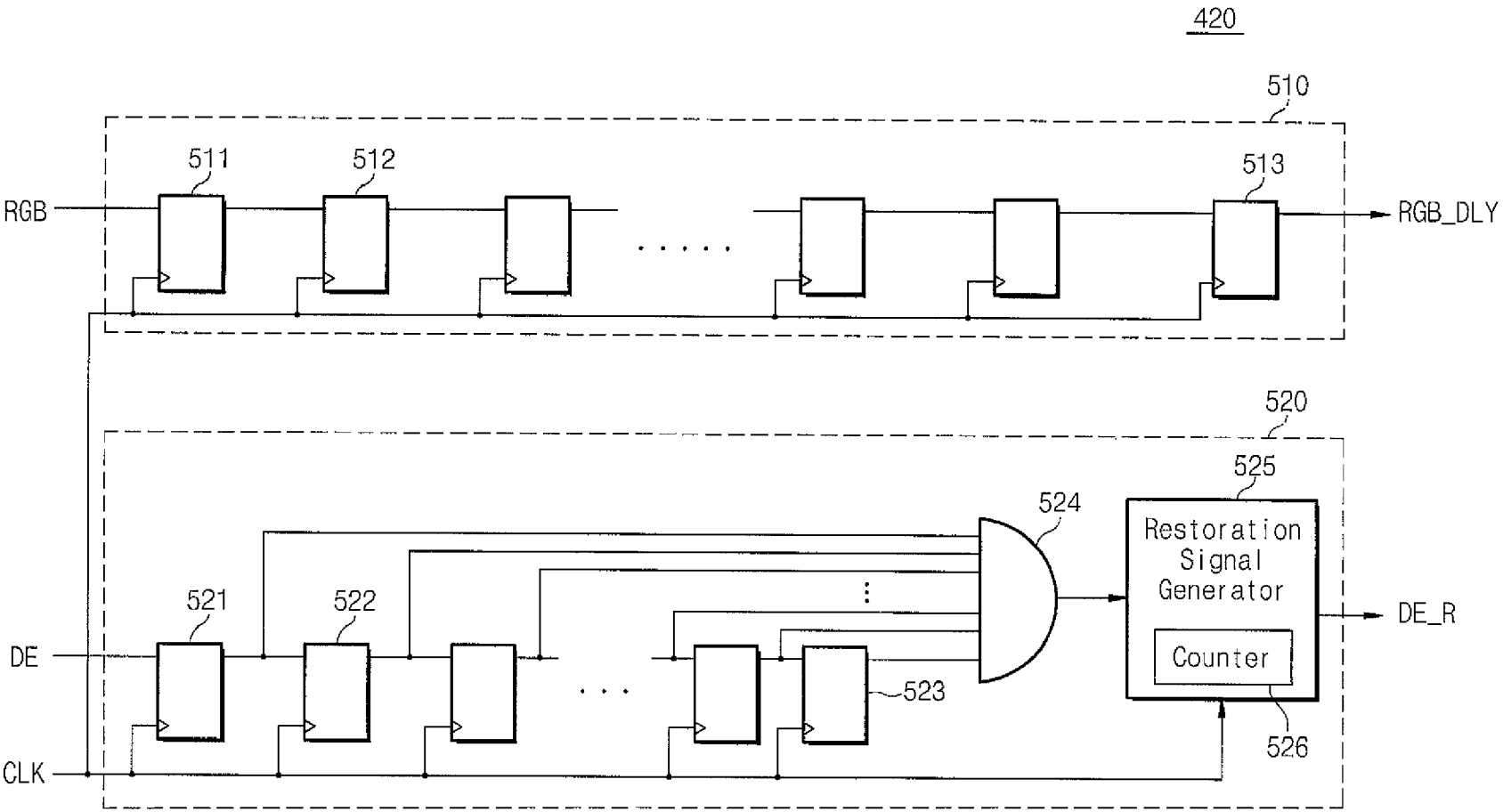
FIG. 5 is a block diagram showing a restoration circuit shown in FIG. 4 according to an exemplary embodiment of the present invention.

FIG. 5 is a block diagram showing the restoration circuit 420 shown in FIG. 4 according to an exemplary embodiment of the present invention. Referring to FIG. 5, the restoration circuit 420 includes a data delay circuit 510 and a restoration block 520. The data delay circuit 510 receives the pixel data signal RGB to output a delayed pixel data signal RGB_DLY.

The data delay circuit 510 includes a plurality of flip-flops 511 to 513 connected to each other in series. The data delay circuit 510 has an input terminal (e.g., the input to the flip flop 511) connected to the pixel data signal RGB and an output terminal (e.g., the output of the flip flop 513) from which the delayed pixel data signal RGB_DLY is output.

The restoration block 520 receives the data enable signal DE and outputs the restoration signal DE_R. The restoration block 520 includes a plurality of flip-flops 521 to 523 connected to each other in series, an AND gate 524 and a restoration signal generator 525. An input terminal of the restoration block 520 (e.g., the input to the flip-flop 521) is connected to the data enable signal DE. Output signals of the flip-flops 521 to 523 are provided to the AND gate 524. The flip-flops 521 to 523 are operated in synchronization with the clock signal CLK. The AND gate 524 outputs a high level signal after the data enable signal transitions into a high level and is delayed by a wave delay time through the flip-flops 521 to 523. When the output signal of the AND gate 524 is transitioned into a high level, the restoration signal generator 525 transits the restoration signal DE_R into a high level. The restoration signal generator 525 includes a counter 526. As the output signal of the AND gate 524 is transitioned into a high level, the counter 526 starts counting and performs a count up in synchronization with the clock signal CLK. When a count value of the counter 526 reaches a preset value, the restoration signal generator 525 transitions the restoration signal DE_R into a low level.

Since the data enable signal DE is delayed and then provided to the functioning block 440, the pixel data signal RGB input from the host may be delayed by a delay time of the data enable signal DE before the pixel data signal RGB is provided to the functioning blocking 440. The number of the flip-flops 511 to 513 in the data delay circuit 510 may be adjusted corresponding to the number of the flip-flops 521 to 523 in the restoration block 520, thereby synchronizing the delayed pixel data signal RGB_DLY with the data enable signal DE_DLY.

Figure 6:
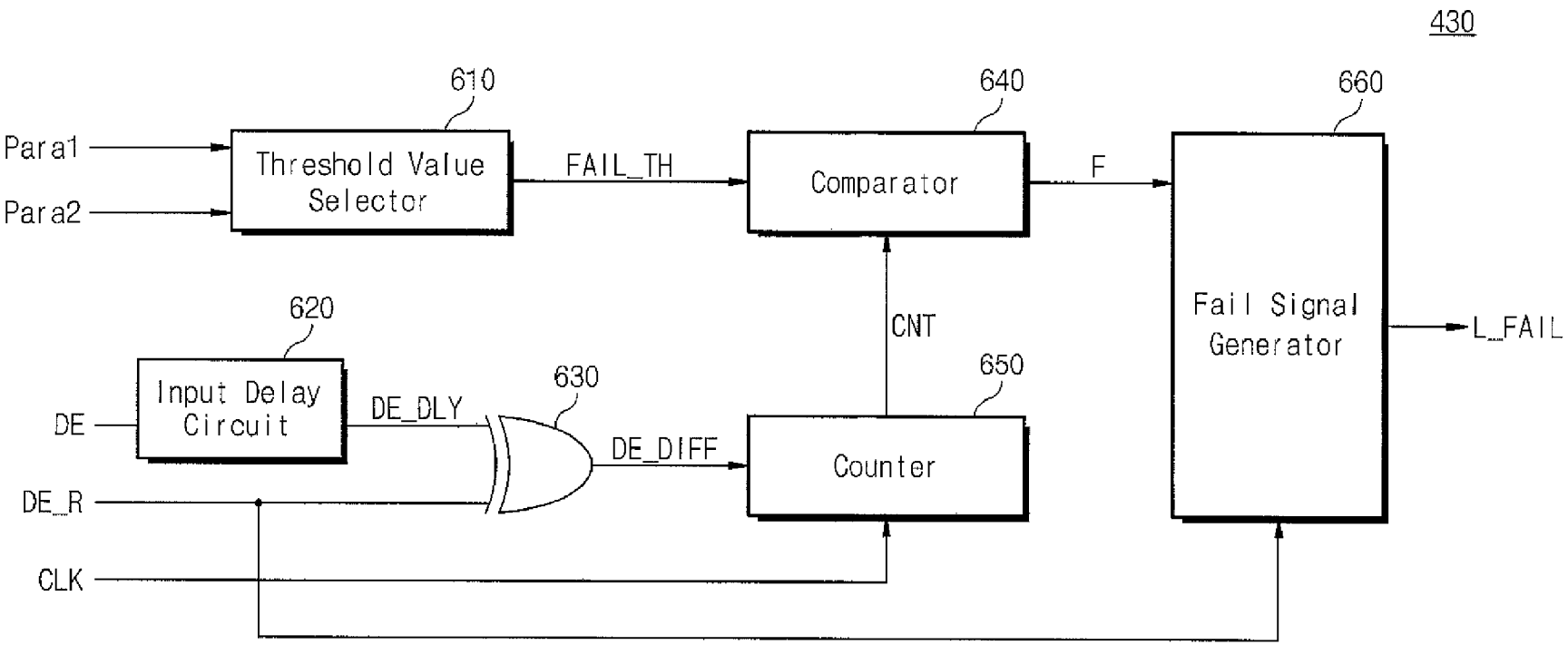
FIG. 6 is a block diagram showing a fail detector shown in FIG. 4 according to an exemplary embodiment of the present invention.

FIG. 6 is a block diagram showing the fail detector 430 shown in FIG. 4 according to an exemplary embodiment of the present invention. Referring to FIG. 6, the fail detector 430 includes a selector 610, an input delay circuit 620, a logic circuit 630, a comparator 640, a counter 650 and a fail signal generator 660.

The selector 610 receives the first parameter Para1 and the second parameter Para2 to output one of the first and second parameters Para1 and the Para2 as a threshold value FAIL_TH.

The input delay circuit 620 delays the data enable signal DE by a predetermined time and then outputs a delayed data enable signal DE_DLY. The logic circuit 630 receives the delayed data enable signal DE_DLY output from the input delay circuit 620 and the restoration signal DE_R provided from the restoration circuit 420 shown in FIG. 4 and then outputs a differential signal DE_DIFF corresponding to a signal difference between the two signals. While FIG. 4 illustrates the logic circuit 630 as including an exclusive OR (XOR) gate, embodiments of the present invention are not limited thereto. For example the logic circuit 630 may include various logic gates that output the differential signal DE_DIFF corresponding to the signal difference between the two signals.

The counter 650 may start counting signals at a rising edge of the differential signal DE_DIFF stop the counting at a falling edge of the differential signal DE_DIFF, and perform a count up in response to the clock signal CLK. For example, the counter 650 provides the comparator 640 with a count value CNT corresponding to a high level section of the differential signal DE_DIFF. The logic circuit 630 and the counter 650 form a pulse width detector that outputs the count value CNT corresponding to the difference between the data enable signal DE and the restoration signal DE_R.

The comparator 640 compares the threshold value FAIL_TH from the selector 610 with the count value CNT from the counter 650. If the count value CNT is equal to or greater than the threshold value FAIL_TH, the comparator 640 activates a comparison signal F. The fail signal generator 660 activates the line fail signal L_FAIL in response to the activation of the comparison signal F and may deactivate the line fail signal F at a timing corresponding to a falling edge of the restoration signal DE_R. The comparator 640 and the fail signal generator 660 form a fail discriminator, which compares the threshold value FAIL_TH with the count value CNT and generates a line fail signal L_FAIL based on the compared result.

Figure 7:
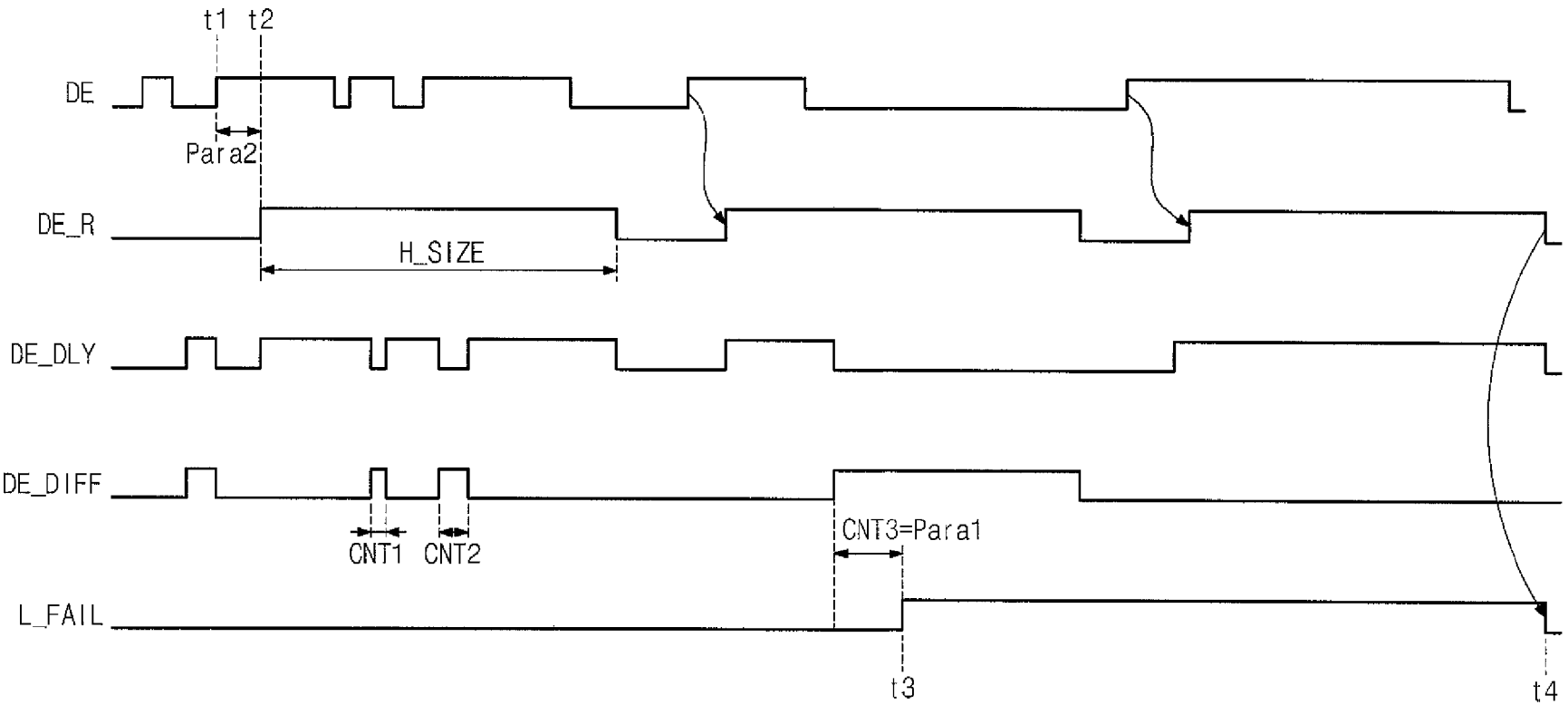
FIG. 7 is a timing diagram showing signals used in the timing controller shown in FIG. 4.

FIG. 7 is a timing diagram showing signals used in the timing controller shown in FIG. 4. As shown in FIGS. 4 to 7, the data enable signal DE is input into the restoration circuit 420. After the data enable signal DE is activated into a high level (t1) and the wave delay time (t2) generated by the flip-flops 521 to 523 lapses, the restoration block 520 activates the restoration signal DE_R into a high level. After the restoration signal DE_R is activated into the high level by the restoration signal generator 525, and then after a predetermined number of cycles of the clock signal lapses, the restoration signal generator 525 deactivates the restoration signal DE_R into a low level. A high level duration of the restoration signal DE_R corresponds to a horizontal size H_SIZE of the liquid crystal panel 150 and may be maintained at a constant level at each cycle when the counter 526 in the restoration signal generator 525 maintains the same preset value.

The data enable signal DE is also input to the fail detector 430. The input delay circuit 620 in the fail detector 430 outputs the delayed data enable signal DE_DLY. According to at least one exemplary embodiment of the present invention, a delay time of the input delay circuit 620 shown in FIG. 6 may be identical to the wave delay time of the flip-flops 521 to 523 in the restoration block 520 shown in FIG. 5. As described above, since the data enable signal DE is delayed to form the restoration signal DE_R, the deleterious effects caused by noise at a rising edge of the data enable signal DE may be minimized. The time difference (e.g., delay time) between the data enable signal DE and the delayed data enable signal DE_DLY is the second parameter Para2.

The logic circuit 630 (e.g., including the XOR gate) outputs the differential signal DE_DIFF corresponding to the difference between the delayed data enable signal DE_DLY and the restoration signal DE_R. Since the restoration signal DE_R from the restoration block 520 has a constant pulse width, if the data enable signal DE is distorted by external factors including electrostatic discharge, the distortion degree of the data enable signal DE is reflected in the differential signal DE_DIFF. The counter 650 provides the count value corresponding to a pulse width of the high level section of the differential signal DE_DIFF to the comparator 640.

As described above, the time difference (e.g., delay time) between the data enable signal DE and the delayed enable signal DE_DLY is the second parameter Para2, and a maximum allowable distortion time of the data enable signal DE is the first parameter Para1.

The selector 610 selects the larger one of the first and second parameters Para1 and Para2 as the threshold value FAIL_TH. According to at least one embodiment of the present invention, the first parameter Para1 is larger than the second parameter Para2. As a result, the threshold value FAIL_TH is set as the first parameter Para1.

As shown in FIG. 7, since count values CNT1 and CNT2 corresponding to the distortion of the differential signal DE_DIFF are smaller than the threshold value FAIL_TH, the line fail signal L_FAIL signal is maintained in a deactivated state.

If a count value CNT3 corresponding to the distortion of the differential signal DE_DIFF is equal to or larger than the threshold value FAIL_TH, the comparator 640 activates the comparison signal F and the fail signal generator 650 transitions the line fail signal L_FAIL into an activated state (t3). As the restoration signal DE_R is transitioned into a low level, the line fail signal L_FAIL is also transitioned into a low level (t4). Accordingly, even if the functioning block 440 operates in a line fail mode in response to the activation of the line fail signal L_FAIL, a pixel data signal of the following line is displayed on the liquid crystal panel 150 in a normal mode.

As shown in FIG. 7, in an abnormal state caused by electrostatic discharge, if the data enable signal DE is distorted in a range beyond the threshold value FAIL_TH, for example, CNT3, the timing controller 110 operates in the fail mode. During the fail mode, the functioning block 440 shown in FIG. 4 allows a predetermined image to be displayed on a corresponding line of the liquid crystal panel 150.

If the data enable signal DE is finely distorted within a range below the threshold value FAIL_TH, for example, CNT1 or the CNT2, the data enable signal DE can be restored by the restoration block 520 in the timing controller 110, and the timing controller 110 does not enter the fail mode. Accordingly, the user does not recognize the distortion of the data enable signal DE even if the data enable signal DE is distorted by the electrostatic discharge.

A manufacturer of the liquid crystal display 100 can change the first and second parameters Para1 and Para2, and a fail recognition range can be variously changed.

Although exemplary embodiments of the present invention have been described, it is to be understood that the present invention should not be limited to these exemplary embodiments, but various changes and modifications can be made by one ordinary skilled in the art within the spirit and scope of the disclosure.

What is claimed is:

1. A timing controller comprising:

a restoration circuit that receives an input signal and outputs a restoration signal based on the input signal, wherein the restoration circuit comprises:

a delay circuit that receives the input signal and delays the input signal to output a delayed input signal;

a restoration signal generator that receives the delayed input signal and generates the restoration signal based on the delayed input signal, wherein the restoration signal generator activates the restoration signal when the delayed input signal is activated and then deactivates the restoration signal after a period of time has elapsed; and a fail detector that receives the input signal and the restoration signal, wherein the fail detector activates a fail signal when a difference between the input signal and the restoration signal is larger than a threshold value.

2. The timing controller of claim 1, wherein the restoration signal generator receives a clock signal, and the period of time corresponds to a predetermined number of cycles of the clock signal.

3. The timing controller of claim 2, wherein the delay circuit comprises:

a plurality of flip-flops that are connected to each other in series and sequentially latch the input signal in synchronization with the clock signal; and a logic circuit that receives an output of each flip-flop to output the delayed input signal.

4. The timing controller of claim 2, wherein the restoration signal generator comprises:

a counter that starts counting in response to the delayed input signal and performs a count up in synchronization with the clock signal, wherein the restoration signal generator deactivates the restoration signal after a period of time has elapsed when a count value of the counter reaches a predetermined value.

5. The timing controller of claim 2, wherein the input signal comprises a data enable signal.

6. The timing controller of claim 5, wherein the restoration circuit further comprises a data delay circuit that receives an image data signal and delays the image data signal based on a delay time of the delay circuit to output a delayed image data signal.

7. The timing controller of claim 6, wherein the fail detector comprises:

an input delay circuit that delays the data enable signal;

a pulse width detector that outputs a differential value corresponding to a difference between a signal output from the input delay circuit and the restoration signal;

a threshold value selector that outputs the threshold value; and a fail discriminator that compares the threshold value with the differential value and activates the fail signal when the differential value is larger than the threshold value.

8. The timing controller of claim 7, wherein the fail discriminator comprises:

a comparator that compares the threshold value with the differential value and activates a comparison signal when the differential value is larger than the threshold value; and a fail signal generator that activates the fail signal in response to the comparison signal and deactivates the fail signal in response to the restoration signal.

9. The timing controller of claim 8, where the fail signal generator deactivates the fail signal at a falling edge of the data enable signal.

10. The timing controller of claim 9, wherein the threshold value selector receives a first parameter corresponding to a fail determination time and a second parameter corresponding to a delay time of the input delay circuit to output one of the first and second parameters as the threshold value.

11. The timing controller of claim 10, wherein the pulse width detector comprises:

a logic circuit that outputs a differential signal corresponding to a difference between the signal output from the input delay circuit and the restoration signal; and a counter that outputs a count value corresponding to a pulse width of the differential signal in synchronization with the clock signal.

12. The timing controller of claim 11, wherein the fail signal is maintained in a deactivated state when the difference between the data enable signal and the restoration signal is smaller than the threshold value.

13. The timing controller of claim 12, further comprising a functioning block that operates in response to the restoration signal and the delayed image data, wherein the functioning block operates in a fail mode when the fail signal is activated.

14. A liquid crystal display comprising:

a liquid crystal panel provided with a plurality of data lines and a plurality of gate lines;

a driving circuit driving the data lines and the gate lines; and a timing controller that receives an image data signal, a data enable signal and a clock signal to output control signals to control the driving circuit, wherein the timing controller generates a restoration signal having a predetermined pulse width in response to the data enable signal and operates in a fail mode when a difference between the data enable signal and the restoration signal is larger than a threshold value.

15. The liquid crystal display of claim 14, wherein the timing controller comprises:

a restoration circuit that delays the data enable signal by a predetermined time to output a delay signal; and a restoration signal generator that generates the restoration signal activated in response to the delay signal and maintains the restoration signal in an activated state for a predetermined cycle of the clock signal.

16. The liquid crystal display of claim 15, wherein the image data signal is delayed by a delay time of the delay circuit and is provided to the driving circuit.

17. The liquid crystal display of claim 14, wherein the timing controller returns from the fail mode to a normal mode when the restoration signal is deactivated.

18. A liquid crystal display comprising:

a liquid crystal panel provided with a plurality of data lines and a plurality of gate lines;

a driving circuit driving the data lines and the gate lines; and a timing controller that receives an image data signal, a data enable signal and a clock signal to output control signals to the driving circuit, wherein the timing controller comprises:

a restoration circuit that receives the data enable signal and generates a restoration signal based on the data enable signal, wherein the restoration circuit comprises:

a first delay circuit that receives the data enable signal and delays the data enable signal to output a delayed data enable signal;

a second delay circuit that receives the image data signal and delays the image data signal to output a delayed image data signal; and a restoration signal generator that receives the delayed data enable signal and the clock signal, activates the restoration signal when the delayed data enable signal is activated, and then deactivates the restoration signal after a predetermined number of cycles of the clock signal have elapsed;

a fail detector that receives the data enable signal and the restoration signal, wherein the fail detector activates a fail signal when a difference between the data enable signal and the restoration signal is larger than a threshold value; and a functioning block that receives the fail signal and the delayed image data signal, wherein the functioning block provides the delayed image data signal to the driving circuit when the fail signal is deactivated and provides a predetermined image data signal indicative of a failure to the driving circuit when the fail signal is activated.

19. The liquid crystal display of claim 18, wherein the fail detector comprises:

an input delay circuit that delays the data enable signal;

a pulse width detector that outputs a differential value corresponding to a difference between a signal output from the input delay circuit and the restoration signal;

a threshold value selector that outputs the threshold value; and a fail discriminator that compares the threshold value with the differential value and activates the fail signal when the differential value is larger than the threshold value.

20. The liquid crystal display of claim 18, wherein the fail detector deactivates the fail signal at a falling edge of the data enable signal.

* * * * *